US006580663B1

(12) United States Patent
Whitmore

(10) Patent No.: US 6,580,663 B1
(45) Date of Patent: Jun. 17, 2003

(54) CELESTIAL TIMEPIECE ASSEMBLY

(76) Inventor: Keith Whitmore, 20410 SW. 126th Ave., Miami, FL (US) 33177

( * ) Notice: Subject to any disclaimer, the term of this patent is extended or adjusted under 35 U.S.C. 154(b) by 208 days.

(21) Appl. No.: 09/643,773

(22) Filed: Aug. 22, 2000

Related U.S. Application Data

(63) Continuation-in-part of application No. 09/094,520, filed on Jun. 15, 1998, now Pat. No. 6,108,277.

(51) Int. Cl.[7] ..... G04B 19/26; G04B 19/22; G04C 17/00

(52) U.S. Cl. ..... 368/15; 368/16; 368/21; 368/223

(58) Field of Search ..... 368/10, 15–20, 368/21, 82, 223, 228

(56) References Cited

U.S. PATENT DOCUMENTS

| | | | | | |
|---|---|---|---|---|---|
| 4,681,459 | A | * | 7/1987 | Nabeyama et al. | 368/16 |
| 5,269,065 | A | * | 12/1993 | Ida | 33/269 |
| 5,457,663 | A | * | 10/1995 | Mejaski | 368/15 |
| 5,519,673 | A | * | 5/1996 | Uehara et al. | 368/15 |
| 6,272,076 | B1 | * | 8/2001 | Dinger | 368/15 |

* cited by examiner

*Primary Examiner*—Vit Miska
(74) *Attorney, Agent, or Firm*—Malloy & Malloy, P.A.

(57) ABSTRACT

A timepiece and combined astrological display assembly including a casing which may be sized to resemble a wristwatch, PDA or a variety of other structures and including a display assembly mounted on the casing. The display assembly is responsive to a processor mounted on the casing and associated with appropriate storage facilities structured to respectively store and depict different categories of information including, the current time of day at a given geographical location, as well as ephemeris data indicative of the movement and positions of the celestial bodies of the Zodiac, and the angular orientation between two planetary bodies for the determination of "Aspects" and/or a plurality of "Aspect" lines, each of which interconnects a selected pair of planetary bodies and facilitates the forecasting of astrological information. The processor also stores the location of a plurality of predetermined geographical sites, and a conversion facility for converting Greenwich Mean Timepiece to current local time. A control assembly, which in one embodiment comprises a keypad assembly, is structured to input general information and selectively access one or more categories of the astronomical information stored in the processor which is used to determine and display a desired astrological forecast.

28 Claims, 5 Drawing Sheets

CELESTIAL TIMEPIECE ASSEMBLY

CLAIM OF PRIORITY

The is a continuation-in-part application of patent application, Ser. No. 09/094,520, filed on Jun. 15, 1998, which matured into U.S. Pat. No. 6,108,277 on Aug. 22, 2000.

BACKGROUND OF THE INVENTION

1. Field of the Invention

The present invention relates to a timepiece, preferably but not exclusively, in the form of a wristwatch to be mounted on the body of a user, which indicates among other things, the signs of the Zodiac and the positions of the celestial bodies or planets, at any given time. The celestial timepiece of the present invention is structured to selectively display predetermined general information such as current local time, date and location, as well as dynamic astrological information based on the current local time and location, such that the user is aided in determining the likely outcome of a plurality of events or occurrences, based on the displayed astrological information, at any given time.

2. Description of the Related Art

The study of the sun, moon, other planets and the stars has been known and enjoyed by man since ancient times. Centuries ago, astrology and more in particular, the study of the movements of planets relative to a person's time of birth were considered to be controlling of the happenings and events during a person's life as well as the eventual outcome of a person's life. In modern times, astrology is becoming an increasing blend of both art and science. Astrologers or those involved in the interpretation of celestial or planetary movements and their impact on people around the world are consulted by people of all types and ages. Interest in astrology for purposes of determining the future and/or the outcome of various events are found not only in the curious, but even in more powerful and influential personages, including world leaders.

The determination of astrological events by the "reading" of the planetary positions and constellations of the Zodiac has historically meant long and tedious hours of calculation of the various planetary orbits and interpretation of that information. In addition, it has long been believed that in order to obtain a reliable horoscope or other pertinent astrological information a so-called "professional" involved in the computation and interpretation of such information must be consulted. While the interpretation of such astrological information is still best placed in the hands of a professional astrologer, the calculation and availability of such information is more easily accessed in contemporary times in that certain manuals have been developed, and software programs as well, to facilitate the computation of various stars and planet locations and orbits.

However, because of the increasing popularity of astrology and the belief that the determination of the outcome of future events can be predicted, there is still a need for a relatively small display assembly, such as a timepiece, which is capable of accurately presenting celestial information such as the movement and relative positions of the planets relative to a geographical location, as well as the current time and date for that locale.

Conventional techniques for displaying time are well known to all and include numerical displays, including rotating hands and the like, and digital displays. Clocks that display the phases of the moon or other features of the solar system are also known, but often are complicated in their construction. In addition, such attempts to provide celestial timepieces seem to rely more on appearance rather than substance, and consequently, are of questionable accuracy in terms of providing substantive astrological information. Further, it is believed that such known devices do not address the need for sturdiness which is typically required of a wearable timepiece.

Accordingly, there remains a need in the art for a combined timepiece and display assembly structured and disposed to display at least a current local time and date for a particular geographical location, as well as the astrological information for that particular geographical location, in sufficient detail to permit a wearer to determine a horoscope or the likely outcome of a particular event. Any such assembly should preferably include a digital display and a representation of the signs of the Zodiac and other planetary bodies of the solar system in a movable array, and more preferably, should also incorporate a fixed depiction of the twelve "Houses" of the Zodiac, all within a casing structured and designed to be wearable in wristwatch form. It would also be preferable to package any such assembly in combination with a simplified astrological guide in order to facilitate the understanding of astrological movements and the interpretation of that information in order to arrive at a prediction for the outcome of a particular event and/or negative or positive influences for a known period of time. Any such assembly should also be accurate in terms of calculating the planetary movements and orbits to an extent sufficient to not only promote the interest of curious amateurs but to be relied upon by experienced astrological forecasters.

SUMMARY OF THE INVENTION

The present invention is designed to address the needs which remain in the art and relate to a celestial timepiece assembly, which may be in the form of a wristwatch, personal digital assistant (PDA), or other digital processor assembly incorporating a display facility. Further, the celestial timepiece of the present invention may assume or be incorporated in a variety of different structural embodiments, which are preferably, but not exclusively, sufficiently small, light weight and compact to be easily carried on or by a user. By way of example only, when incorporated in a wristwatch or like structure, it may be sized and configured to be mounted on the wrist or other convenient location on the user's body. In the preferred embodiment, the celestial timepiece of the present invention is digitally operative and includes a processor or central processing unit ("CPU"), which may be in the form of a microprocessor specifically sized to be carried within a casing of a wristwatch, pocket watch, PDA or similar type of instrument. In its simplest form, the present invention may be used to maintain and display local times. In addition, the date and geographical location may be stored and possibly displayed.

More specifically, one embodiment of the present invention includes a casing sized and configured to correspond to a substantially conventionally sized wristwatch having some type of connecting wristband or strap mounted thereon to facilitate attachment to the wrist or other convenient part of the user. The present invention further includes a display assembly having a display face mounted in an exposed position on the casing. In one embodiment of the present invention, the display surface preferably comprises an annular band formed of the same rigid material as and integral with the casing and is formed of an at least partially transparent material for viewing. A cover member formed of a rigid yet clear material can be provided with the casing and disposed so as to overlie and protect the display assembly. The display assembly is preferably a liquid crystal display (LCD) which is clearly viewable through the cover member, if one is provided, and further, is preferably centrally disposed on the casing, at a center region adjacent to the display surface, and effectively defines a majority of the exposed surface of the casing. In order to accomplish digital activation of the display assembly, it is connected either directly or indirectly through conventional circuitry to the workings of the CPU. The CPU or processor is electronically structured and disposed to incorporate and/or to communicate with a plurality of databases, each having appropriate memory facilities for the storage and maintenance of a variety of different information. Further, the CPU and the provided databases are structured and disposed to be cooperatively responsive with one another so that the variety of different information, including certain additional information which is inputted into the CPU, can be organized and stored in various pre-determined categories. The CPU is structured and disposed to access, process, receive and/or transmit stored information or data to the display assembly. As a result, at least one embodiment of the present invention comprises the display of certain astrological information, from one or more of the pre-determined categories on or along movable paths of travel located on segregated portions of the display assembly, which are viewable through the exposed surface of the casing.

In addition, one embodiment comprises a first pre-determined category of astrological information preferably defined by an array of Zodiac signs, each of which is associated with a planetary ruler having its own planetary sign and being representative of one of the twelve celestial houses. Each of the Zodiac signs is preferably displayed and disposed along an outermost, annular periphery of the display assembly. Further, each Zodiac sign is movable along the annular periphery in what may be defined as a first viewable path.

A second pre-determined category of astrological information comprises a depiction of the movement of each of the celestial bodies relative to earth, as defined by an ephemeris. The ephemeris is configured to calculate the positions of each of the plurality of celestial bodies and/or planets during their ordinary sequence of movement on various dates throughout a pre-determined timepiece period of at least one, but preferably a plurality of years. Further, the second pre-determined category of astrological information is also displayed on the display assembly, preferably along a second annular region thereon, concentric and adjacent to the first viewable path, in what may be referred to as a second viewable path. Each symbol for a celestial body is movably depicted along this second viewable path, with the movements of each being responsive to the CPU and ephemeris so as to generally correspond with actual planetary movements in a relatively accurate fashion. Also, it is preferred that this second path or inner annular band moves relative to the first path, such that the various positions of the planets shown as movable relative to one another, are also depicted moving relative to the various signs of the Zodiac which define the first pre-determined category of astrological information.

A third pre-determined category of astrological information preferably comprises an array of "Aspect" lines, each of which is preferably disposed in a substantially central portion of the display assembly, in surrounded relation by both the annular bands of the first and second paths, as set forth above. Preferably, this third pre-determined category of information will be only selectively displayed, as about to be explained.

The present invention also comprises activating control means. These may include a control assembly structured and disposed to permit the selection and/or inputting of data to the CPU, such as but not limited to the time of a particular geographical location, the name and place of that particular geographical location and/or its latitude and longitude, etc. Supplementary information may also be added such as, but not limited to, a user's date of birth, etc., for reasons to be explained in greater detail hereinafter. In addition, the control assembly is further structured and disposed to activate the CPU so as to selectively display certain information on the display assembly. Preferably, the CPU will be programmed to include a "default" and/or "clear" mode, whereby the display assembly visually displays one or more of the geographic location and date, any of which can be selectively altered by manipulation of the control assembly. In this embodiment, the control assembly can be manipulated, whenever it is desired, to cause the CPU to interrupt or clear the current display mode and to preferably display another one of the predetermined categories of astrological information. For example, the display of the first and second categories of information may be interrupted or cleared to display the third category of astrological information defined by the aforementioned visual array of "Aspect" lines.

With respect to the third pre-determined category of information, each "Aspect" line preferably extends between the symbols corresponding to two planets or celestial bodies, and also, preferably displays an indicating symbol which relates to the angular orientation between those two planets or celestial bodies. That is, the CPU of the present invention is configured or structured to calculate the angular orientation between the planetary bodies displayed on the display assembly, and further, to present for display a pre-selected indicating symbol, adjacent substantially each Aspect line, at some point along the length thereof. The indicating symbol displayed adjacent each Aspect line preferably is determined by the angular orientation of the Aspect line, as it is generated from one planetary body to another. Further, the indicating symbol will preferably identify the angular orientation of the Aspect line as at least the following: "conjunction", "opposition", "trine", "square", and "sextile". Each of the aforementioned angular orientation identifiers is pre-determined for the indication of whether there is a favorable or positive influence versus an unfavorable or negative influence surrounding a particular situation that the user may wish to "ask" about, in hopes of predicting the outcome of an event or the like.

In addition, one embodiment of the display assembly preferably has a generally circular configuration which further, is divided into twelve equally dimensioned segments of generally about thirty degrees each. Collectively, the plurality of segments, which are twelve in number are defined into an annular band or circle of 360 degrees. Each of these segments represent a particular "House" of the Zodiac, and in accordance with astrological teachings, each "House" has a particular theme, meaning that it influences a particular subject of life, such as financial matters, family matters, romantic matters, etc. Also, included in the embodiment referred to above, it is preferred that the body of the casing, and in particular, an outer periphery thereof adjacent to the display assembly, includes indicia thereon to provide directional indicators such as North, South, East and West.

Yet another preferred embodiment of the present invention comprises a casing which may be in the form of a wristwatch or other structural configuration, including but not limited to a small, compact and preferably portable personal computer. Such portable units are more commonly known as personal digital assistants (PDA). More specifically, this embodiment of the present invention is digitally operative and comprises a casing having a display assembly mounted thereon in an exposed position. The display assembly is preferably, but not exclusively, in the form of an LCD. Also, a processor of the type discussed above, is mounted on or within the casing and connected to the display assembly in a manner which facilitates activation of the display assembly to display predetermined astrological information. In addition, the display assembly and processor may be cooperatively structured to display and compute other information including the time of day, geographical location at which the celestial timepiece piece is located, date, and other more personalized information, such as the users birth date.

This embodiment of the present invention further comprises a control assembly which includes a plurality of buttons or input devices which may be utilized to input and/or "call-up" the aforementioned information including the date, time of day, geographical location, etc. One structural feature of this embodiment of the present invention comprises the control assembly including a key pad assembly having a plurality of keys. The keys are operatively interconnected to the central processor by appropriate circuitry in functional cooperation with the display assembly, such that selective display may be depicted on the display assembly which includes certain, predetermined categories of astrological information in addition to other information such as date, time of day, location, etc.

As with previously described embodiments of the present invention, the plurality of categories of astrological information comprises a first category which includes a plurality of Zodiac signs each associated with and representative of a particular house of the Zodiac. In addition each of the Zodiac signs are directly associated with one of the planetary signs representative of a planet or other celestial body. As explained in greater detail hereinafter, at least a portion of this first category of astrological information may be displayed concurrently with other information on the display assembly.

The plurality of categories of astrological information also includes a second category comprising ephemeris data or an "ephemeris calendar" stored in the processor and/or a databases associated therewith. The ephemeris data is determinative of the relative positions between the plurality of celestial bodies and/or planets, as graphically represented by the aforementioned planetary signs. Further, the ephemeris serves to calculate or determine the relative positions of the celestial bodies during their ordinary sequence of orbital movement on any specific date, throughout a predetermined time period of one or more years. As also explained in greater detail hereinafter, the plurality of planetary signs are preferably displayed on the key pad assembly of this embodiment, rather than directly on the display assembly as in the previously discussed embodiments.

The plurality of categories of predetermined astrological information further comprise a third category including "Aspect" information which more specifically is associated with the relative positions of two celestial bodies or planets and even more to an angle of separation between any two of the planetary bodies at any given time. The various Aspects are displayed by depicting any one of a plurality of designators or designator signs each of which are representative of either a favorable or unfavorable influence relating to a specific subject, about which the user is inquiring.

Accordingly, in this embodiment of the celestial timepiece of the present invention a user may inquire as to a specific subject matter to determine whether a favorable or unfavorable influence exists relating to that subject. This is accomplished by first knowing or determining the specific House of the Zodiac which is associated with a particular subject matter. Thereafter, the control assembly and more specifically the key pad assembly is manipulated by first observing a first category of astrological information in the form of the plurality of Zodiac signs depicted on the display assembly in an interrelated array. Both the House associated with the subject of inquiry, as well as the "opposite" House, are determined by referring to the substantially aligned relation of the corresponding Zodiac signs, defining the interrelated relay. Such information is "input" into the processor through manipulation of the specifically designated ones of the plurality of keys of the key pad assembly, by noting the corresponding planetary signs of the House of inquiry and the House opposite thereto.

Additional keys other than those associated with the planetary signs of the plurality of celestial bodies are included in the key pad assembly in order to display at least a portion of the aforementioned third category of astrological information including the Aspects. After proper operation or manipulation of the keypad assembly, one of the "favorable" or "unfavorable" designator signs will be displayed on the display assembly as an indication of the inquired subject matter being under a favorable or unfavorable influence.

In addition to the above, additional astrological information may be depicted such as the position of each of the planetary signs relative to a specific House located in an ascendant position. The location of a particular Zodiac sign and accordingly a celestial body relative to a specific House of the Zodiac as indicated as it passes through a "mid-heaven" position. The ascendant position is used to reference the position of the sun at sunrise and the mid-heaven position is generally used to refer to the position of the sun at its highest point in the sky.

Inquiries relating to other astrological information can also be performed and depicted on the display assembly by additional manipulation of the key pad assembly, as well as the other operative buttons or activating members mounted on the casing and also considered apart of the control assembly.

Accordingly, the celestial timepiece assembly of the present invention may be embodied in anyone of a variety of different structures, at least some of which are capable of being conveniently carried on the person of the user and which is operable to indicate at least a current time as well as display certain astrological information relating thereto. Moreover, at least one embodiment includes a central processing unit, preferably in the form of a microchip, and a digital display, capable of providing a visual representation of various categories of astrological information relating to the relative positions of one or more celestial bodies and/or planets at a particular date, timepiece and geographical location.

Yet another important object of the present invention is to provide a celestial timepiece which incorporates a display assembly that movably depicts a plurality of various categories of astrological information, such that the categories of information can easily be both read by a person and correlated to one another so as to enable that person to easily determine whether the planetary influences are "favorable" or "not favorable" in terms of the desired outcome of a future event. More specifically, the celestial timepiece assembly allows the concurrent viewing of various categories of astrological information and the selective viewing of yet an additional category of astrological information so as to enable one to determine whether the planetary influences are either "favorable" or "unfavorable" in terms of a desired outcome of one or more future events.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
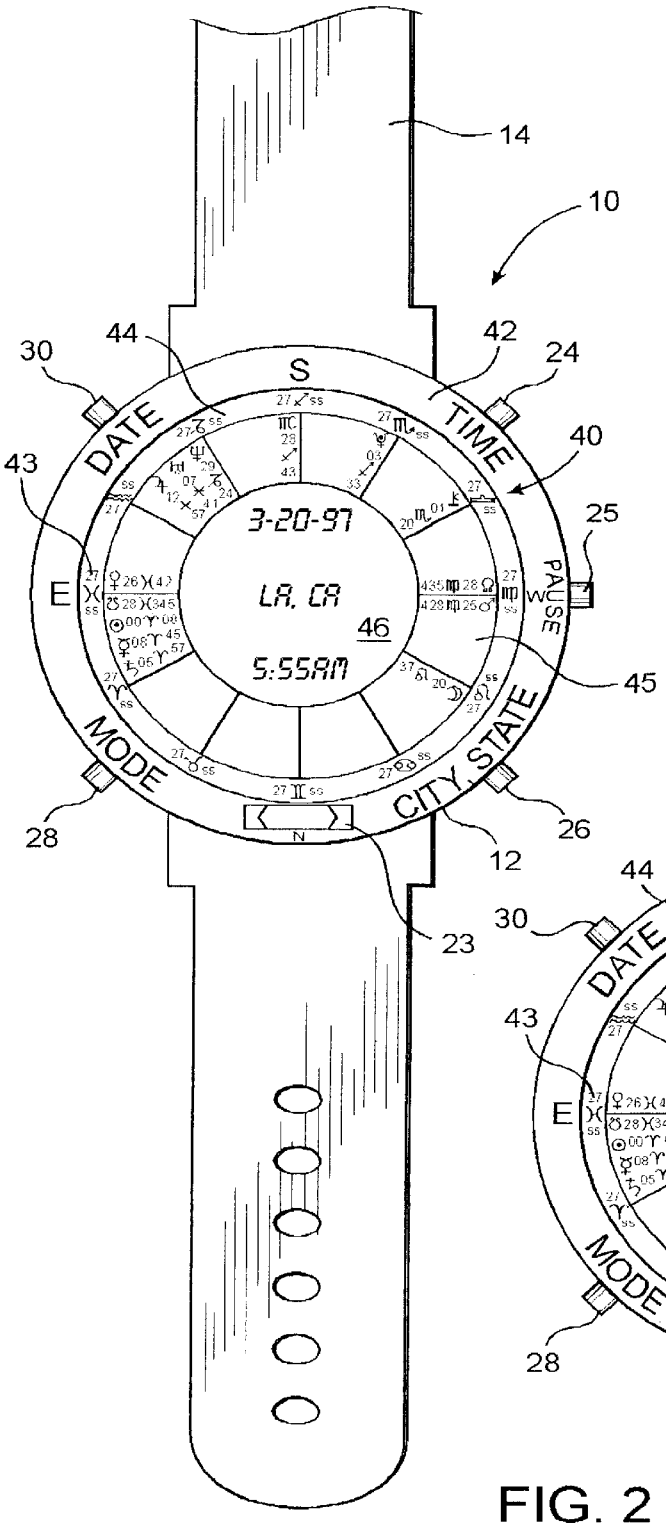
FIG. 1 is a front view of the celestial timepiece assembly according to the present invention depicting a first operative mode thereof.
Figure 2:
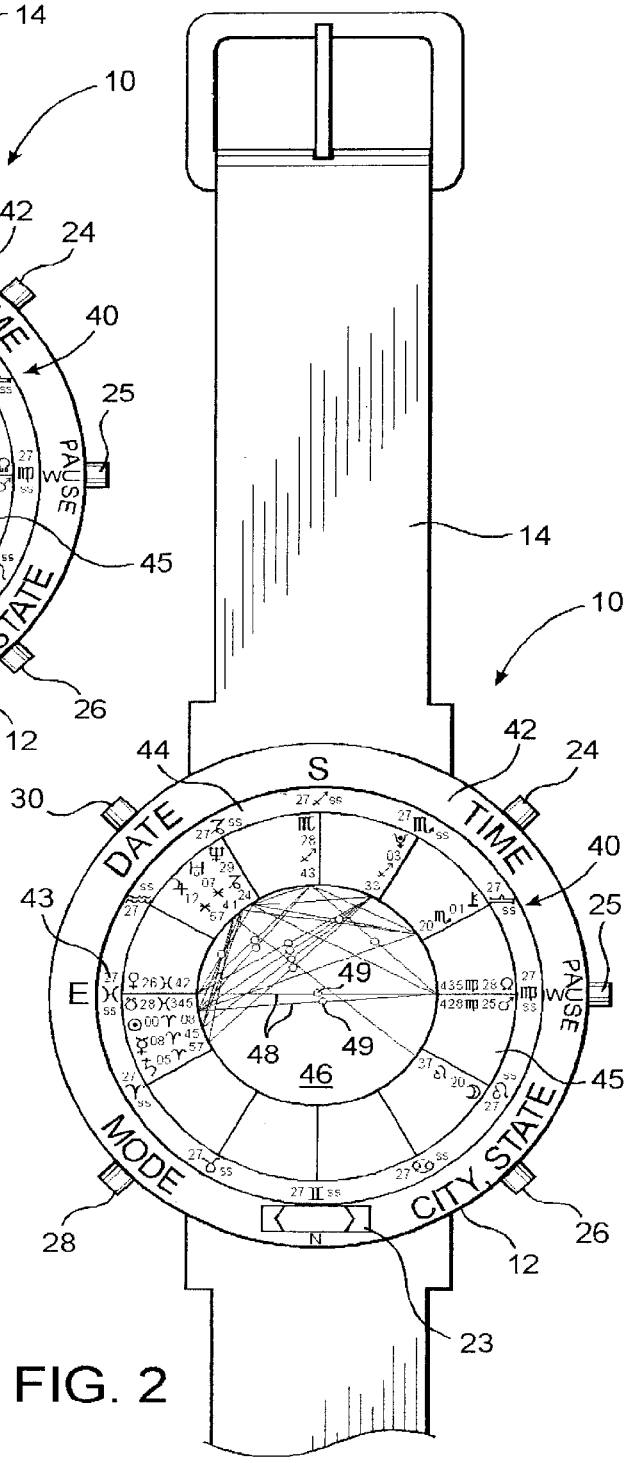
FIG. 2 is a front view of the celestial timepiece assembly illustrated in FIG. 1 and depicting a different operative mode thereof.

As shown in FIGS. 1 and 2, one embodiment of the present invention is directed towards a celestial timepiece assembly, and is generally indicated by reference numeral 10. More in particular, the celestial timepiece assembly 10 is structured and disposed to indicate at least a current time as well as certain astrological information, to be described in greater detail hereinafter. In addition, the date and/or the geographical location of the user may also be displayed.

In the preferred embodiment, the celestial timepiece assembly 10 is in the form of a wristwatch comprising a casing 12, formed from a suitable material such as plastic or a rigid metallic material, and a flexible connecting strap 14 or a similar suitable structure designed to removably attach the casing 12 about the wrist of the wearer. It should be understood, however, that the present invention also contemplates a celestial timepiece assembly that may take other forms, for instance, a pocket watch or other wearable timepiece. The celestial timepiece of the present invention may also take the form of a more conventional clock, which may be too large or too heavy to be conveniently carried on the body of the person utilizing the present invention. Other structural embodiments of the present invention may include a small, compact portable microprocessor such as, but not limited to, the type commonly known as a personal digital assistant or PDA, which will be described hereinafter.

With further reference to FIGS. 1 and 2, the celestial timepiece assembly 10 preferably includes a display surface 42 and a display assembly 40, mounted on the casing 12. As illustrated, the display surface 42 preferably comprises an annular band formed of the same rigid material as the casing 12 of the celestial timepiece 10 and which is structured and disposed to preferably present a flat surface for viewing and to surround the display assembly 40.

Ideally, the display surface 42 includes certain visual indications relevant to the accurate reading of the celestial information provided by the celestial timepiece 10. As illustrated in FIGS. 1 and 2, these visual indications preferably include directional indicators such as are found on a conventional compass, namely, North, East, South, West, or abbreviations therefor, such as "N", "E", "S", "W", although the arrangement of these indicators on the display surface 42 will be unconventional. That is, the directional indicators, such as East, South, West, North, are preferably arranged on display surface 42 in an inverted orientation relative to a conventional compass, so as to represent the viewing of the heavenly bodies from a position wherein one lies on the ground looking skyward with his or her head pointing to the North, as opposed to the directional indicators found on a conventional directional compass which are structured for travel over the earth's surface. Further, the visual indications on display surface 42 may also include and will preferably include certain operating indicators such as "Date", "Time", "Pause", "City/State" and/or "Mode", the purpose of which will also be described in more detail, below. In addition to the display surface 42, the celestial timepiece assembly 10 preferably includes a display assembly 40. As illustrated in FIGS. 1 and 2, the display assembly 40 is preferably centrally disposed on the casing 12, at a center region adjacent to and concentrically inwardly from display surface 42. In at least one additional embodiment, the display surface 42 effectively defines a majority of the exposed outer surface of the casing 12.

The display assembly 40 is structured and disposed to display certain astrological information as well as to permit the selective display of at least a current local time and preferably the date, as well as certain additional astrological information, as will be described in more detail hereinafter. The display assembly 40 preferably comprises a liquid crystal display (LCD) operatively connected to a processor, described herein with primary reference to FIG. 7. If desired, the display assembly 40 may be provided with a cover member formed of a durable transparent material to both protect the LCD from damage and yet facilitate viewing of the display assembly 40. The display assembly 40 preferably comprises a liquid crystal display (LCD) operatively connected to a processor, described herein with primary reference to FIG. 7. If desired, the display assembly 40 may be provided with a cover member formed of a durable transparent material to both protect the LCD from damage and yet facilitate viewing of the display assembly 40.

Figure 7:
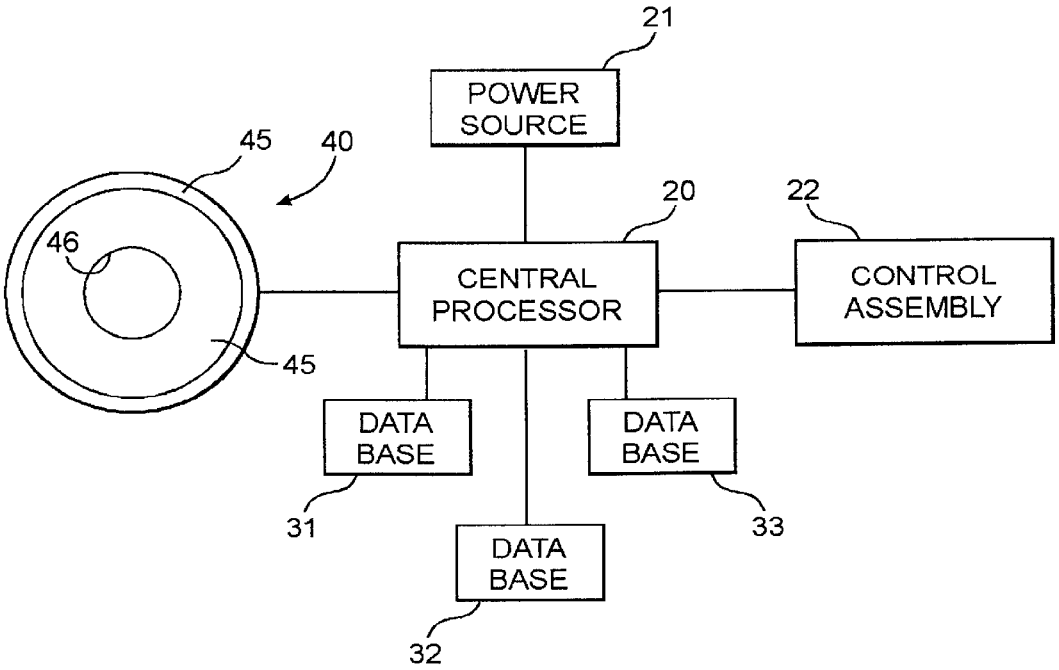
FIG. 7 is a schematic representation in block diagram form of operative components of the embodiment of FIGS. 1 and 2 of the present invention.

With reference to FIG. 7, at least one embodiment of the celestial timepiece assembly of the present invention comprises a processor or central processing unit (CPU) 20 programmed to receive, store, organize, operate and transmit data or information pertinent to performing the intended functions of the present invention. A suitable CPU can comprise, for example, an individual chip, such as one of Intel Corporations 80226, 80386, 80486, or 80586 chip series. Ideally, the CPU 20 comprises a microprocessor or chip dimensioned to sufficiently fit within an interior region of a casing 12 or other casing or housing, dependent on the embodiment of the present invention. The CPU 20 additionally includes memory means for storing the program or software to be executed by the CPU as well as certain additional information (including data) to be inputted into the CPU 20 by a user. Examples of suitable CPU memory means include the random access memory (RAM), such as is commonly associated with a CPU and the like. The CPU 20 also includes means for outputting information and/or data to the display assembly 40, preferably in the form of the Liquid Crystal Display or LCD, discussed above, and related circuitry for operatively connecting or interconnecting with same to accomplish the display of the desired information. In addition, the present invention includes a power source 21, preferably one or more small batteries, such as a long life Nickel-Cadmium battery, housed within the casing 12 and in electrical communication with the CPU, so as to supply power to the CPU and other components of the celestial timepiece assembly 10.

Further, the CPU 20 is operatively connected to means for inputting information which preferably comprise at least one control assembly 22. That is, certain data, important to the operation of the timepiece 10, can be inputted into the central processor or CPU 20 by way of at least one control assembly 22. In the preferred embodiment, however, and as illustrated in FIGS. 1 and 2, the control assembly 22 comprises a plurality of push button structures mounted on casing 12, as designated by reference numerals 24, 26, 28 and 30. The preferred control assembly comprising push button structures 24, 25, 26, 28 and 30, are also disposed in an-accessible location on the casing 12, such as on a periphery thereof so as to readily permit the wearer to physically manipulate them, such as with his or her finger(s). In this regard, adjacent each push button structure the display surface 42 preferably includes at least one operating indicator such as "Date", "Time", "Pause", "City/State" or "Mode", described previously, correlated to visually indicate the function of that particular push button structure. Further, the control assembly 22 and/or button structures 24, 25, 26, 28, and 30 is/are structured and disposed to be in operative communication with the CPU 20 so as to permit the effective input of data and/or information there into, and preferably, into the program or software being operated by the CPU 20. Also in the preferred embodiment, at least one button structure of the control assembly 22, such as "Pause" button 25, is structured and disposed to activate the celestial timepiece assembly 10 in terms of choosing between a continuous or temporary display on the preferred LCD of the display assembly 40 of either a current local timepiece and date or various categories of information related to the astrological presentation.

Applicable to the various embodiments of the present invention, and with further reference to FIG. 7, the software or computer program being operated by the CPU 20 may also include one or more databases 31, 32, 33, each of which is representative of a predetermined category of information. A first database, designated by reference numeral 31 may be structured to store at least a first category of astrological information corresponding to celestial bodies such as, but not necessarily limited to, the sun, moon, and other planets of our solar system and the constellations of the Zodiac, and further, will preferably store a designated symbol for each planet defined by a sign of the Zodiac. A second database 32 may be structured to store certain additional astrological information relating to the orbital paths followed by each of these planets and/or constellations over a defined period of time, and as such, will preferably comprise at least one ephemeris, i.e., one or more table(s) giving the coordinates of one or a number of planets and celestial bodies at a number of specific times during a defined period, ideally for at least one year, but which could also be for more, such as generally about 5 to 7 years. A third database 33 may be structured and disposed to store certain additional astrological information relating to the angles of separation between any of the planetary bodies stored within the first and second databases, at any given time, and the visual depiction of a plurality of "Aspect lines" between the various planetary bodies. This third database 33 may also be structured and disposed to store a plurality of indicating symbols, each of which correlates to a particular angle or degree of separation between two planetary bodies. While each of these categories of information will be explained in greater detail hereinafter, it is pointed out at this juncture that the CPU 20 is structured and disposed to access these databases either in sequence or simultaneously and to perform certain calculations. By way of example, by virtue of these databases and the program(s) run on the CPU 20, the location of two particular planets can be determined at a particular time by utilizing the ephemeris of the second database, and further, the "Aspects" or "Aspect line" between two particular celestial bodies or planets can also be determined by calculating the geometric angle between the two particular celestial bodies or planets at that particular time. In accordance with astrological teachings, the geometric angle between a selected two celestial bodies, as further described herein, offers the ability to determine whether a favorable or unfavorable influence is likely to be exerted at that particular time, for a given subject matter.

Further with regard to FIG. 7, the central processor 20 is further structured to include sufficient storage capabilities to maintain a program and/or database which preferably comprises an atlas of many predetermined geographical locations, such as but not limited to, some 200 or more cities located within the United States or other countries throughout the world, and the latitude and longitude associated with each location, and further, a program and/or database which comprises a conversion table between Greenwich Mean Time ("GMT") and the current local time at one of the various pre-determined geographical locations, so as to correlate information stored as part of the ephemeris in the second database, which typically is set for GMT. It should be pointed out that many other geographical locations throughout the world may be added and stored into the program and/or one or more databases of the central processor 20, such as by means of the latitude and longitude coordinates of a particular geographical location. As set forth above with reference to the embodiment of FIGS. 1 and 2, all of the aforementioned data can be inputted through physical manipulation by the user of the control assembly 22, which preferably comprise the access buttons 24, 26, 28, and 30. In addition, the control assembly 22 may include a fine tuning control facility, such as indicated by reference numeral 23, which is structured and disposed to provide a menu and for the scrolling display and selection of the various cities, months, days, years, hour, minutes, etc. Thus, the fine tuning control facility 23 may also be considered as part of the control assembly 22 for regulating the input, for example, of the specific time and/or date depicted on the display assembly, as will be explained in greater detail hereinafter. Also, the control assembly 22 may incorporate a push button structure, 25, marked on the casing 12 near the designation "Pause," to temporarily "stop" the timepiece calculations of the CPU while the user momentarily performs another function with the assembly 10.

Referring again to the embodiment of FIGS. 1 and 2, the display assembly 40 of the present invention will now be described in greater detail. As illustrated, the display assembly 40 is structured and disposed to have a generally circular configuration and further, to display a plurality of segments in fixed, non-movable relation to one another. Most preferably, the plurality of segments are twelve in number, each being equally dimensioned to another, and collectively defined in an annular array or circle of 360 degrees. Each of these segments corresponds to about 30 degrees of the array and represents a particular "House" of the Zodiac. In accordance with recognized astrological teachings, each "House" is associated with a particular theme or one or more at least generally related subjects, as set forth on FIG. 3.

In addition, the display assembly 40 is structured and disposed to depict a plurality of segregated, viewable paths. A first viewable path is indicated by the reference numeral 44 and is seen to comprise a generally annular band disposed about the outer periphery of the display assembly 40. This first viewable path 44 is structured and disposed to ideally present each symbol corresponding to each sign of the Zodiac, and further, with each symbol being movable incrementally along and about the annular band defining the first viewable path 44. Ideally, each symbol moves there along in a clockwise direction from a station adjacent one of the fixed segments defining a "House", described above and in more detail below, to another station adjacent the next segment defining a preceding "House," (in that the segments defining the various Houses of the Zodiac are read in a counterclockwise direction starting from the reference letter "E" for East where the first House is located) The movement of these signs preferably serves to track and is consistent with the timing of the corresponding Zodiac sign's stellar movement along its orbital path relative to and about the earth. In this regard, the preferred symbols for each sign of the Zodiac which appear along the incrementally moving visual first path 44 are represented in the table illustrated FIG. 4. The table of FIG. 4 further indicates the planetary ruler associated with each of the Zodiac signs, for a purpose which will become more clear from the discussions below.

More specifically, and as has been described, the display surface 42 includes certain visual indications relevant to the accurate reading of the celestial information provided by the celestial timepiece 10. In the embodiment of FIGS. 1 and 2, these visual indications include directional designations such as are found on a conventional compass, namely, North, East, South, West, or abbreviations therefor, such as "N", "E", "S", "W". The reference letter "E," representing the directional designation "East" is an initiating point of reference in that it preferably defines a "point of ascension" for the reading of the astrological information. That is, for any given city or other geographical location on earth, there is an eastern horizon and as the earth rotates, one or more of the various constellations of the Zodiac and other planetary bodies are ascending on that horizon, at any given time, whether day or night, and then, are continuously moving across the heavens, relative to earth, and even relative to each other with respect to the assembly 10, the letter "E" then is preferably a starting point for the reading the astrological information, and even for the reading of the various fixed segments corresponding the various "Houses" of the Zodiac. That is, once the CPU has been programmed and has received and stored the inputted information, and in particular with respect to the user's particular geographical location and time, the CPU will access the various information within the databases and will transfer the accessed information to the display assembly 40 for display of the generally accurate positioning of the planets and/or celestial bodies. At any given time, a user will know what planets and constellations are ascending on the eastern horizon at that particular location, and the general location of other celestial bodies, relative thereto.

Returning to the first viewable path 44, the depiction of each sign of the Zodiac preferably moves along the annular band defined thereby in accordance with the "equal" House system, wherein each House occupies generally about 30 degrees of the circular display, as described above. If desired, positioned adjacent to each sign of the Zodiac on first viewable path 44 can be displayed a certain number, indicated by reference numeral 43 in FIGS. 1 and 2, which for purposes of this example is the number "27". This number represents a more accurate position of the given sign of the Zodiac as it passes through a particular House by displaying the degrees of the specific location of a given sign. In this example, the numeral 27 indicates that the sign of the Zodiac has three more degrees to reach 30 degrees, whereupon it will pass completely through the House indicated and into the next House. Additional numbers may also be located adjacent a given sign which is indicative of the "minutes" thereby giving an even more precise indication of the exact location of a sign within a given House as it passes there through.

In the embodiment of FIGS. 1 and 2, the display assembly 40 is also structured and disposed to depict a second viewable path 45. The second viewable path 45 is preferably defined in part by the fixed display of the twelve equally dimensioned segments in a circular array, which as discussed above are intended to represent twelve "Houses" of the Zodiac. Preferably though, this second viewable path 45 is also defined by the movable display of a plurality of symbols, each of which corresponds to a particular planet or celestial body. The location of each symbol representing a celestial or planetary body is preferably determined with the aid of an ephemeris, as has been described with reference to the second database. An ephemeris comprises a table which provides the positions of a plurality of celestial bodies and planets throughout one or more years, wherein the planets or celestial bodies are represented during their ordinary sequence of movement relative to one another. Accordingly, the second viewable path 45 is also preferably in the form of annular band disposed concentrically inward from the first annular path 44, and further, is structured and disposed to present each of the symbols corresponding to the planets and in certain embodiments, the signs of the Zodiac wherein the symbols/signs are continuously movable along the annular band 45 in a clockwise direction, in a manner which tracks and is consistent with the timing of the corresponding planet's movement along its orbital path, in accordance with the ephemeris.

Still referring to FIGS. 1 and 2, in the preferred embodiment the display assembly 40 also includes a third viewable area, namely, a central display area, designated by reference numeral 46. As shown in FIG. 1, the central display area 46 is preferably structured and disposed to display at least the time, and preferably, also the date and geographical location of the user. The central display area 46 could also be blank, until such time as it is desired to read the date and time or other astrological information, whereupon a user may manipulate the control assembly. More specifically, a user can manipulate one of the control assembly buttons, such as 28, and thereby, activate the CPU 20 so as to change the display presented on the central display area 46.

In one embodiment, the CPU 20 is programmed to return continuously to a "default" mode" wherein the time alone and/or the time in combination with the date and/or the geographical location of the user are displayed on central display area 46, until such time as the user desires to view additional astrological information. Preferably, whenever that is desired, the user easily manipulates one of the control assembly buttons, and the CPU in response changes the information presented on central display area 46, ideally to a depiction of a plurality of "Aspects" visually represented as lines 48, as shown in FIG. 2. As has been described previously, each "Aspect" or line relates to an angle of separation between a selected pair of celestial bodies, which angle can be identified as one of those appearing in the table of FIG. 5. In that vein, and as will be discussed subsequently, it is important which two planets or celestial bodies are selected for evaluating the "Aspect" line between them. More specifically, the user will have a particular subject matter about which he or she is inquiring and consequently, will evaluate the "Aspect" between "controlling" planets or bodies for that particular subject matter, in order to determine whether there is a positive or a negative influence being exerted at that timepiece.

Figure 5:
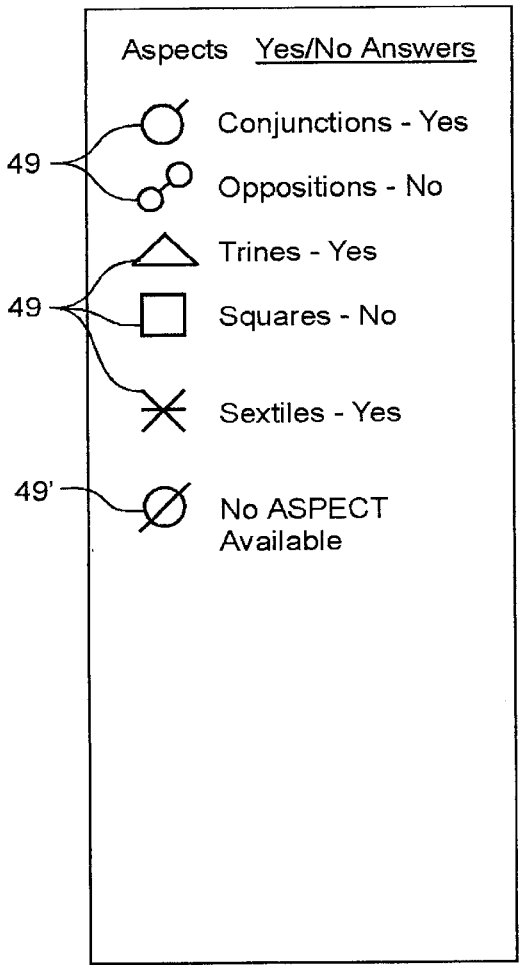
FIG. 5 is a table illustrating the indicator symbols for an "Aspect" line as well as the corresponding angular orientations between two planetary bodies, which are useful for determining whether the influence exerted is either "YES" for "favorable" or "NO" for "unfavorable," at a given time and date.

To aid a user in knowing the angular orientation between two such planets, the display assembly 40 is more preferably structured and disposed to also present a plurality of viewable symbol designators 49, each of which corresponds to a particular angle of separation, as shown on the table of FIG. 5. Preferably, one of these viewable symbol designators 49 will appear adjacent to each of the plurality of "Aspect" lines 48, so as to correctly identify the angle between a selected pair of planets/constellations at a given timepiece. These viewable symbol designators 49 are as depicted in FIG. 5 and represent the specific angular orientation of each of the "Aspect" lines between "controlling" planets or constellations. By way of example, and with reference to FIG. 2, the angular orientation between the planets Mars and Neptune is 120 degrees. Accordingly, the viewable symbol designators 49 for a triangle appears at the "Aspect" line between these two celestial bodies so as to identify the angle represented as "trines," which is a favorable indication or a positive influence. As another example, and still referring to FIG. 2, the angular orientation between the two planets Pluto and Uranus is 60 degrees, and accordingly, the viewable designator symbol 49 appears at the "Aspect" line between them, which symbol is an asterisk like symbol which corresponds and identifies a "sextiles" designator, seen in FIG. 5, also believed to exert a favorable or positive influence. On the other hand, and still referring to FIG. 2, an angular orientation of "180 degrees" for an "Aspect Line" between two controlling planets such as the Sun and Mars, for instance, is interpreted to be an "opposition," which is believed to exert an unfavorable or negative influence, and accordingly, the appropriate symbol from FIG. 5 would appear on the "Aspect" line between these two planets. Similarly, an angular orientation of "90 degrees" for an "Aspect Line" between two controlling planets such as Uranus and Chiron is interpreted to be a "squares," which is believed to exert an unfavorable or negative influence, and in that example, a square symbol would appear adjacent the "Aspect" line extending between these two planets. As also indicated in FIG. 5, another viewable symbol designator 49 may be provided to represent a "conjunction," which is indicative of a favorable response. However, a conjunction arises when there is an angular orientation of zero degrees between two selected or controlling planets. In that "Aspect" lines between controlling planets having no effective separation or a zero degree separation, the "Aspect" line would preferably not be visible on the display assembly 40 of the timepiece 10. Accordingly, there is no representation for the viewable designator 49 of a "conjunction" on the embodiment of FIG. 2.

By permitting the visualization of the "Aspect" line for a selected pair of celestial bodies, a person can determine whether the bodies are likely to influence the outcome of a future event in a favorable or unfavorable way. More in particular, the celestial timepiece assembly 10 readily permits the selective viewing of an appropriate symbol designator 49, seen in FIG. 5, on each of the "Aspect" lines 48, and as a result, when the user wishes to become informed as to the likely outcome of an event, the subject matter of which is defined by one of the controlling celestial bodies of the House being asked about, either a favorable ("YES") or unfavorable ("NO") outcome can be gleaned. In the various embodiments of the present invention, the viewable symbol designators 49 will appear automatically adjacent each line representing an "Aspect" as a result of the CPU 20 performing calculations as to the location of two particular planets or bodies at a particular timepiece. Such calculations will be accomplished utilizing the ephemeris of the second database, responsive to the geometric or "geo centric" angle between two particular planets at a particular timepiece. The CPU and related circuitry are structured and disposed to automatically send the resulting image in visual display form to the central display area 46.

Figure 3:
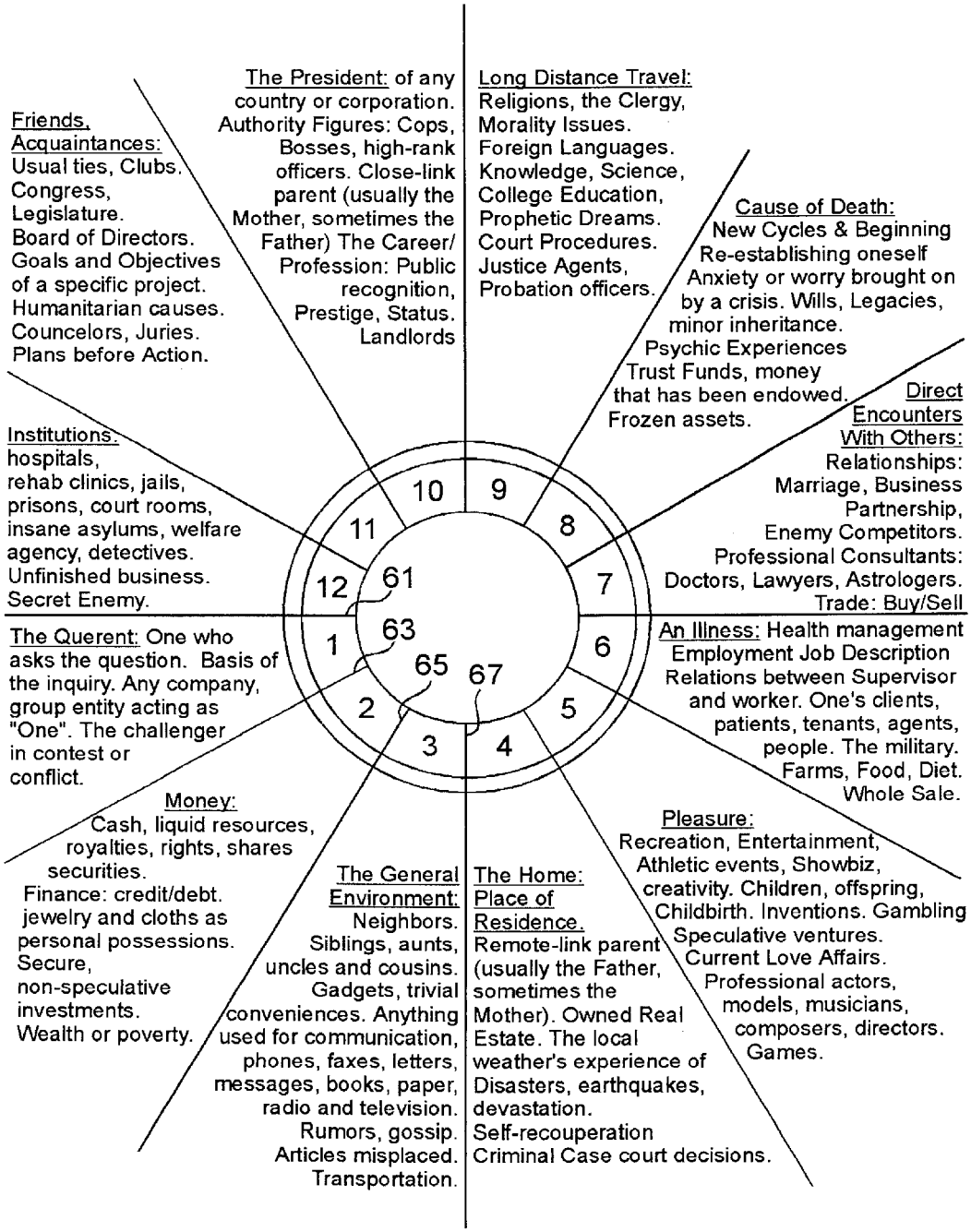
FIG. 3 is a schematic representation of the twelve "Houses" of the Zodiac, with an indication as to the subject matter believed to be controlled by each House.

Referring to FIGS. 1 and 2, it should be pointed out again that the twelve "Houses" of the Zodiac are preferably represented as being fixed in terms of their relative positions to one another on the display assembly 40. More in particular, and as illustrated in FIG. 3, astrological teachings suggest that each "House" corresponds to or has domain over a particular subject matter, and in order to obtain a generally accurate prediction of a particular event, the user will want to refer to the "House" for that particular subject matter. Further, the "cusp" of each House is preferably represented on the display assembly 40 by a fixed dividing line, such as 61, 63, 65, 67, etc. representing the cusp of Houses 1, 2, 3, 4, etc., respectively, as shown in FIG. 3. Also, and with reference to the wristwatch embodiment depicted in FIGS. 1 and 2, beginning with initial point of reference indicated by the letter "E" (for East) on the casing 12, which represents the point of ascension, each of the twelve Houses extends through an arc or segment of generally 30 degrees, such that the twelve Houses collectively define an annular or circular array of 360 degrees, as also depicted in FIG. 3, which can also be conveniently depicted on the face of a clock or the preferred wristwatch 10.

If a person wishes to utilize the celestial timepiece assembly 10 of the present invention to inquire about a particular issue, he or she will need to determine the "House of Origin" for that issue. By way of example, if the user wants to inquire about the subject of money or finances, then the "House of Origin" for that issue, as can be determined from FIG. 3, is the second (2nd) House. Next, the user will want to determine which planet or celestial body is "controlling" of the selected House of Origin, whichever planet that may be depending upon the specific current time and geographical location of the user. Thereafter, the user will determine what House is the "Opposite House" to the "House of Origin" or the House disposed opposite 180 degrees thereto. Continuing with the example of an inquire on finances, meaning that the 2nd House is the House of Origin, then the "Opposite House" in this case is the 8th House, which relates to subject matter for the endings of a cycle, more commonly referred to as the "Cause of Death." Here again, the user will next determine which planet is the "controlling" planet or body for that "Opposite House," which will vary depending upon the particular time and geographical location at which the inquiry is being made. Finally, the user would then locate these two "controlling" planets, preferably on the second viewable path 45 and would then consult the "Aspect" of the two planets. As set forth above, the Aspect is represented as a displayed line 48 on the central display area 46, with the angular orientation between the selected planets or bodies calculated by the CPU 20 and further displayed by the CPU with an appropriate one of the viewable symbol designators 49, set forth in FIG. 5, displayed closely adjacent the "Aspect" line.

Figure 6:
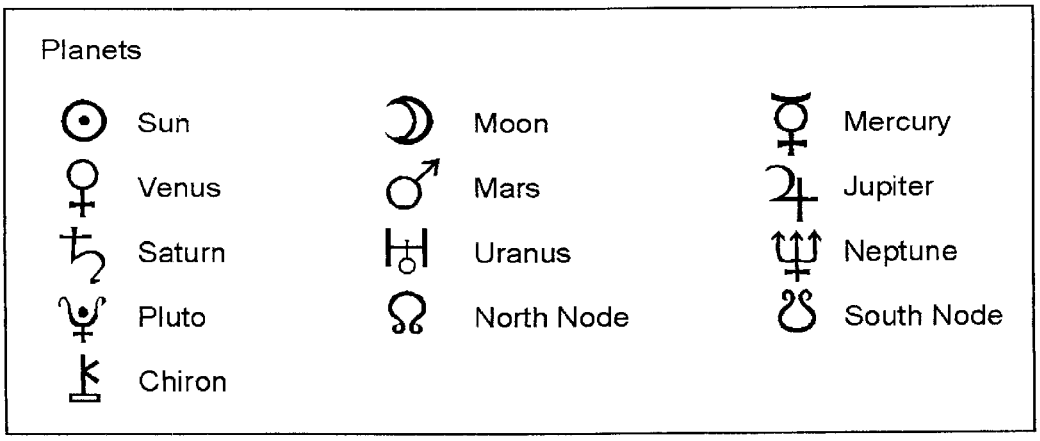
FIG. 6 is a table illustrating the symbols which correspond various planets and celestial bodies within the Zodiac.

With reference to FIG. 6, the various visual designators representative of the planetary bodies such as the Sun, Venus, Saturn, Pluto, Chiron, etc., are represented. As described above, the designators for these planetary or celestial bodies preferably appear on the second visual path 45 of the display assembly 40 and more preferably, will appear to travel there across in a clockwise movement, similar to the various signs of the Zodiac which move incrementally within the first viewable path 44. However, in actuality the relative positioning and movement of the celestial bodies or planets indicated by the designators in the Table of FIG. 6, move counterclockwise at a much "slower" pace but, as set forth above, appear to be "carried along" with the clockwise movement of the zodiac array of the first viewable path 44.

Once the celestial timepiece assembly 10 has been "set" through the input of a current local time, date and geographical location by manipulation of the various activating buttons 24, 26, and 30, the viewable first and second paths 44 and 45 begin to move in synchronization, based on the current local time. It should be appreciated that the planets displayed as traveling along second visual path 45 in accordance with an ephemeris, discussed previously, travel at their individual velocities, and further, that the first viewable path 44 comprised of the Zodiac signs makes a complete circular rotation once every twenty-four hours. Therefore, a user of the celestial timepiece assembly of the present invention would visually be able to discern an apparent rising and setting of the various planets as well as constellations of the Zodiac, which in reality is the turning of the Earth about its axis every twenty-four hours.

To operate the celestial timepiece 10, a first preferred step involves a user entering data into the CPU 20, which is accomplished by manipulation of one of the buttons 24, 26, 30 of the control assembly 22. Ideally, the celestial timepiece 10 can be purchased with the CPU previously programmed with the various databases, 31, 32, 33 and as otherwise described previously, such that this initial step merely involves locating the city name or other geographical designated name for where the user is located, such as by scrolling through a series of displayed city names presented on the central display area 46, and then entering a selected city name by means of the fine tuning control facility 23. Both the current local timepiece and date for that geographical location will automatically be input and/or indicated by appropriate control buttons 24 and 30. Next, the user should become familiar with the various signs representing the constellations of the Zodiac shown in FIG. 4, the symbols representing the various planetary bodies, shown in FIG. 6, the symbols for angular orientations between planets or "Aspects," as set forth in FIG. 5 with their respective "YES/Positive" or "NO/Negative" influences, and further, with the various "Houses" of the Zodiac, and each's attendant subject matter, as illustrated in FIG. 3.

As has been described, the preferred wristwatch embodiment of the present invention displays as a default, the current local time and date for and the name of a geographical location, on the central display area 46. When the user desires to access information regarding a given subject or to inquire about a future event, he or she will preferably interrupt the above-described preferred display mode of the wristwatch, ideally causing it to pause momentarily, by manipulating the control assembly, such as push button structure, 28, at any given time. The central display area 46 of the display assembly 40 is then activated by the CPU 20 so as to be selectively changed from the information depicted in FIG. 1, to that of FIG. 2, wherein the plurality of "Aspect" lines 48 are displayed. As set forth above, the "Aspect" lines 48 will serve to interconnect planets, in order to provide a visual indication of their angular orientation to one another, and the appropriate designator 49 for that angle will also appear adjacent the pertinent "Aspect" line. From that, the user will arrive at an answer which indicates that the planets are exerting either a favorable/positive influence on that issue or an unfavorable/negative one, which should be determinative at least in a general sense of the user's inquiry.

In another embodiment of the present invention, it is contemplated that celestial timepiece assembly 10 will be structured so as to not depict certain information such as, but not limited to, date, time, location, etc. While such information is important for the accurate determination of certain astrological information including the presentation of the "Aspect" lines 48 and the viewable symbol designators 49 thereon, it may be desirable, in certain instances to present an assembly 10 which, in fact, computes the local, current date and time through the operation of the CPU 20 but does not display such information. In such an embodiment, the central display area 46 may be left blank or may depict certain fanciful designs as well as other representations or indications until activated to display the aforementioned and described "Aspect" lines 48.

To provide a more detailed description of the manner of operating of the celestial timepiece assembly 10 so as to aid with predicting the likely outcome of a particular event, the following steps should preferably be followed:

1. Locate which of the twelve Houses of the Zodiac pertains to the subject matter about which the user desires to inquire, as indicated in FIG. 3, and locate that House as the "House of Origin" on the second visual path 45, which will be represented by the fixed segments appearing thereon.

Figure 4:
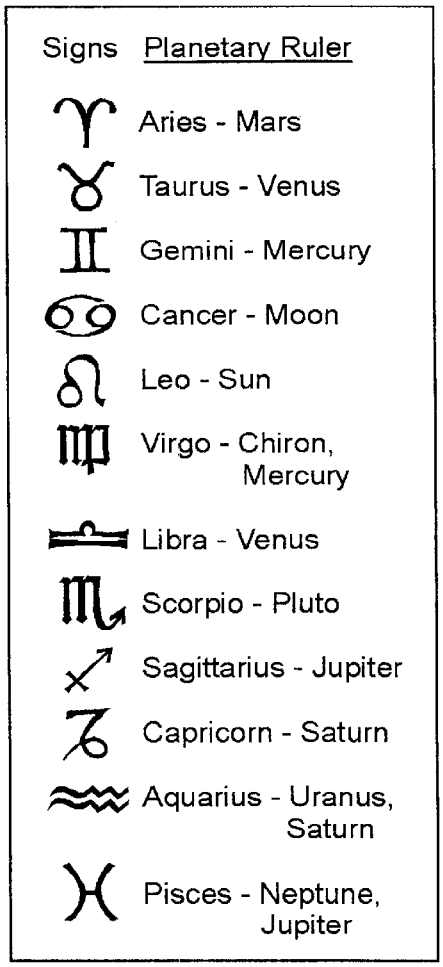
FIG. 4 is a table illustrating the symbols for various signs of the Zodiac with the associated planetary ruler listed for each sign.

2. Take notice of the sign of the Zodiac located on the "cusp line" (61, 63, 65, 67, etc.) of the pertinent "House of Origin," and determine the planetary ruler for that sign of the Zodiac, as indicated in the table of FIG. 4.

3. Look for the "Opposing House" to the "House of Origin" by looking for the House which is disposed six spaces or 180 degrees away from the "House of Origin," also on the second visual path 45, as this "Opposite House"

will be used to establish the answer or likely outcome for that particular subject matter.

4. Take notice of the symbol for the Zodiac sign which is placed on the cusp of the "Opposite House" and determine the planetary ruler of that sign, by referring to the Table of FIG. 4.

5. Take notice of the "Aspect" line interconnecting the first controlling planet of the "House of Origin," identified in step 2, above, with the second controlling planet of the "Opposite House," identified in step 4, above, and note the angular orientation, and in particular, the displayed one of the various symbol designator 49, consulting if necessary, the table depicted in FIG. 5.

6. Should the displayed one of the symbol designators 49 be one of the three which equate with a "YES", this is an indication that the likely outcome of the event asked about or of an intended act will be favorable.

7. On the other hand, should the controlling planet from the "House of origin" (or House of inquiry) form an unfavorable "Aspect" to the second planet controlling the opposite House, the symbol designator 49 displayed will be one of the two equating with a "NO" answer meaning that the outcome of one's intention to act would be unfavorable.

8. If no "Aspect" line forms between the two or related controlling planets, the problem is shown to be too involved for direct "yes" or "no" answers or there is a "0 degree" of separation between the controlling planets. In such an event, further analysis is required.

Figure 10:
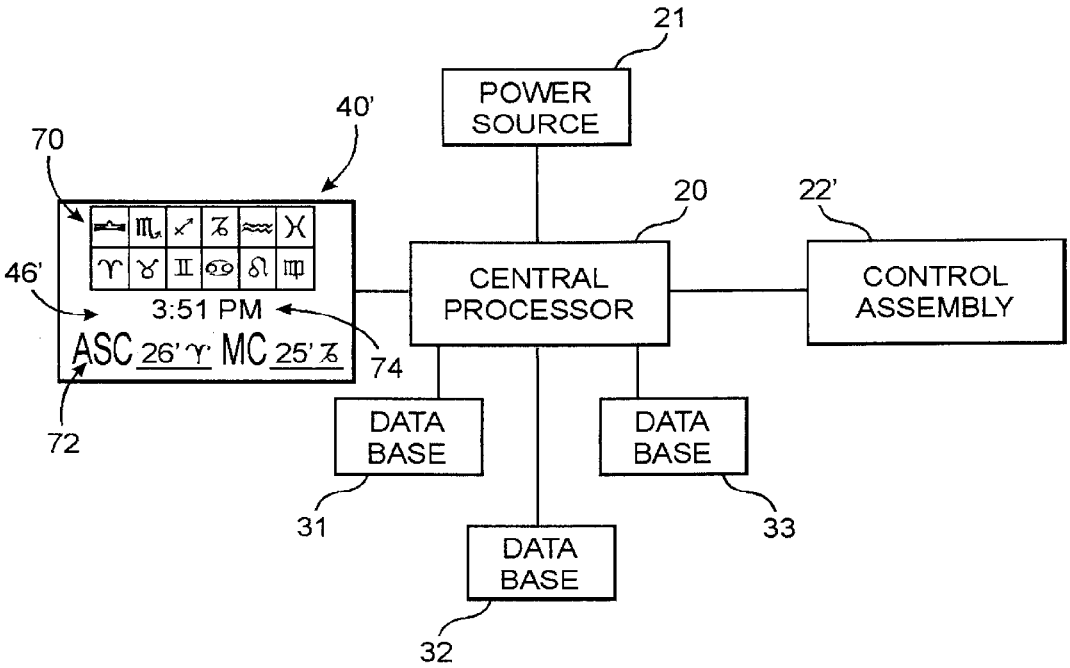
FIG. 10 is a schematic representation in block diagram form representing operative components of the embodiments of FIGS. 8 and 9.
Figure 8:
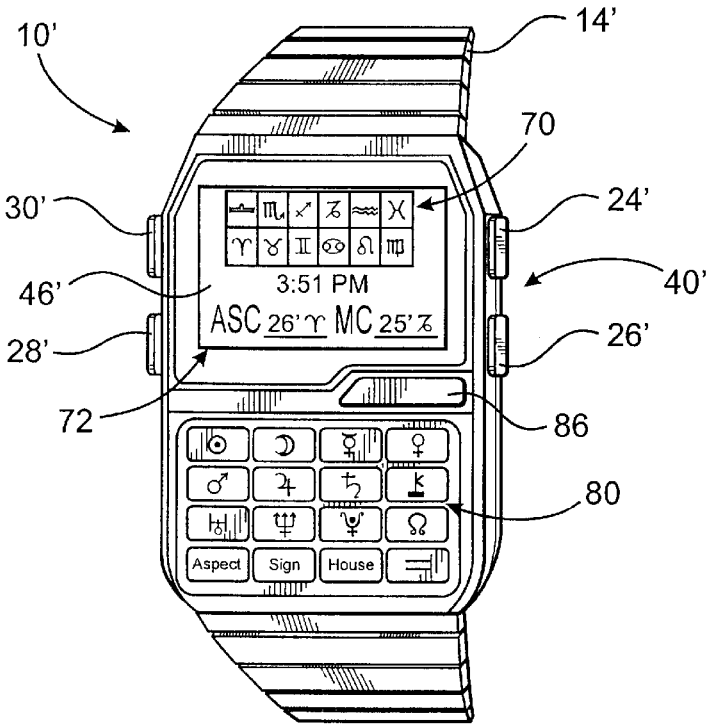
FIG. 8 is a perspective view of yet another embodiment of the celestial timepiece piece assembly of the present invention.
Figure 9:
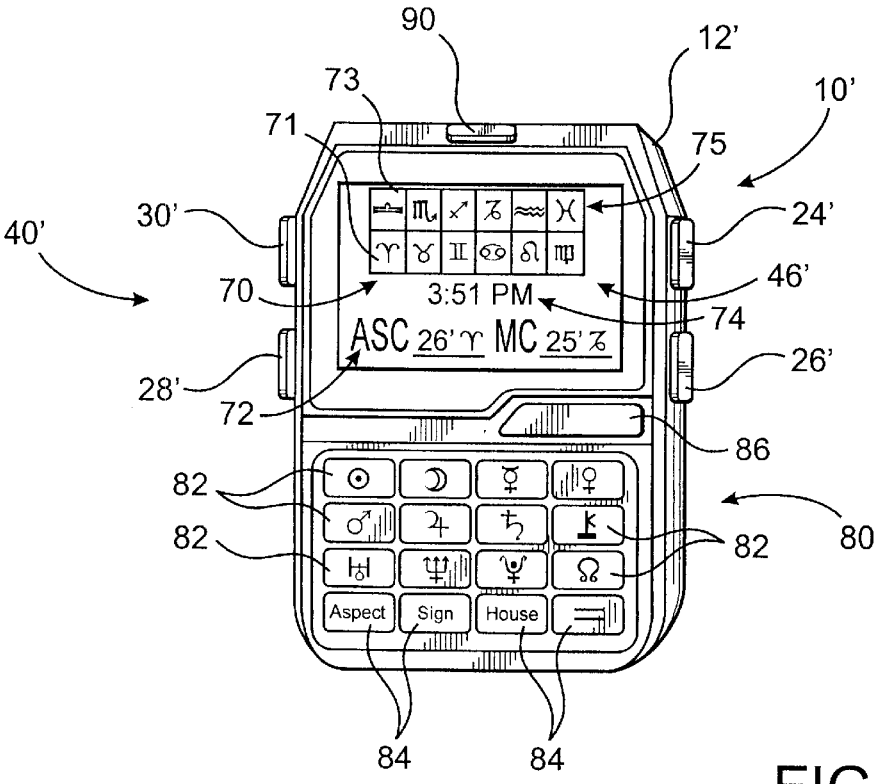
FIG. 9 is a front plan view of yet another embodiment of the celestial timepiece piece of the present invention operatively and structurally similar to the embodiment of FIG. 8.

Another embodiment of the celestial timepiece of the present invention is indicated as 10' and is primarily disclosed in FIGS. 8 through 10. As with the previously described embodiments of the present invention, the celestial timepiece 10' may have a variety of different structural embodiments including a wristwatch, as demonstrated in FIG. 8 and/or a small, compact, portable computer or processor unit, of the type commonly known as a PDA and which is disclosed in FIG. 9. While the structural variations of FIGS. 8 and 9 may vary in terms of practical application (wristwatch versus PDA) they are considered to be substantially equivalent embodiments, in terms of their operative components, as set forth in greater detail hereinafter.

Accordingly, the celestial timepiece piece 10' comprises a casing 12' including a central processor 20, which may be of the type set forth above, and which is associated with a plurality of databases 31, 32, 33, etc. also to be described in greater detail hereinafter. With further reference to FIG. 10, a power source 21 may be in the form of a rechargeable, nickel cadmium battery or a variety of other energizing components applicable to provide electrical energy to the central processor 20, as well as the other components of the celestial timepiece piece 10'.

The control assembly 22' may be activated and operated through manipulation of a plurality of accessible buttons or members 24', 26', 28', 30', etc. Manipulation of anyone of these buttons may serve to selectively input a variety of data required to correctly operate the celestial timepiece piece 10', including the adding of date, time, geographical location, and other pertinent data. Moreover, the control assembly 20' and central processor 22' may be cooperatively structured to provide a "scrolling" feature through the manipulation of any of the aforementioned control buttons or members 24', 26', 28', 30' etc. The aforementioned categories of information, including date, time, etc. may be input into the storage facilities associated with the central processor, by scrolling through a plurality of possible times, dates, etc.

As also to be explained in greater detail hereinafter, the celestial timepiece 10' includes a display assembly generally indicated as 40' including display screen or face 46' on which anyone of a plurality of different categories of information may be independently or concurrently displayed. Such information may include different categories of astrological information, as indicated at 70 and 72, or various categories of more general information. The various categories of general information 74 may include the time, as indicated in FIGS. 8 and 9, as well as the separate or concurrent depiction of other information including the date, geographical location, etc.

Again with primary reference to FIGS. 8 through 10, the control assembly 22' differs from the previously described embodiments of FIGS. 1 and 2 in that it further comprises a key pad assembly generally indicated as 80. The key pad assembly 80 comprises at least a plurality of "indicator" keys 82 and a plurality of "function" keys 84. The keys 82 and 84 are operatively interconnected to the central processor 20. Due to the cooperative structuring of the control assembly 22' and the central processor 20, manipulation of the various keys 82 and 84 will serve to control or determine the display of the various categories of astrological information depicted on the screen or surface 46', of the display assembly 40'. Appropriate switching facilities and circuitry are provided to accomplish the operative interaction between the control assembly 22', including the key pad assembly 80, and other components with the central processor 20.

The control assembly 22' also includes a "clear" button or member 86 which serves to generally control or regulate which of the aforementioned plurality of categories of astrological information and general information are independently or concurrently depicted on the display screen or surface 46'. The pressing or other manipulation of the clear button 86 may serve to clear the entire screen and subsequent and/or successive depressions or manipulations of the clear button 86 will serve to clear the screen 46' and/or "call-up" the various categories that are appropriate to the procedure being performed by the user of the celestial timepiece piece 10'.

As with the above described embodiment of FIG. 7, and with reference to the new embodiment of FIG. 10, the central processor 20 is designed to include certain storage facilities which may be incorporated directly in a processor chip or alternatively a plurality of databases 31, 32, 33, etc, accessible by the processor 20. The aforementioned plurality of categories of astrological information may include a first category of astrological information comprising, but not limited to, various signs of the Zodiac as indicated in FIG. 4 as well as various celestial bodies or planets, indicated as "planetary rulers" associated with each of the Zodiac signs. Therefore, the first category of astrological information may also include the various planetary signs as indicated in FIG. 6, which correspond to or are conventionally used in the field of astrology to indicate the various celestial bodies or planets.

The plurality of categories of astrological information also includes a second category comprising "ephemeris" data. For purposes of clarity the term "ephemeris" may be generally defined as one or more collections of data in the form of a table, calendar, etc. which includes the location of the planets or celestial bodies (see FIG. 6) at any specific time during a defined period of time. The preferred period of time will be at least one year but more preferably may be extended to about 5 to 7 years. Therefore, the central processor, by storage of the second category or ephemeris data is programed or otherwise structured to compute or determine the position of the celestial bodies of the Zodiac, relative to one another at any given point in time over the predetermined time period. The central processor 20, as set forth above with regard to the embodiment of FIG. 7, is programed and/or structured to consider the specific geographical location of the celestial timepiece 10' as well as the specific time at such geographical location. Further, the third category of astrological information may be stored in the second database 32 or other databases associated with the processor 20. Naturally, this information may maintained in other storage facilities associated with the processor 20.

A third category of astrological information which may be maintained in a third or other database as at 33, contains "Aspect" data. In astrological terms, the term "Aspect" is meant to be indicative of the relative positions and more specifically the angle of separation between any two of the planetary bodies at a specific time and relative to a specific geographical location. Accordingly, when a user requests an "Aspect" the stored information of the first, second, and third categories of astrological information are processed by the pre-programed or structured processor 20 to compute or determine the relative positions of two planetary bodies, each of which are directly associated with one of the twelve Houses of the Zodiac. As discussed above each of the Houses of the Zodiac relate to at least one but more commonly a plurality of specific subjects as clearly indicated in FIG. 3.

In addition to the above, the third category of astrological information may also be structured and disposed to include a plurality of identifiers or identifier signs, each of which correlate to a particular angle or degree of separation between two celestial bodies. Therefore, the location of two particular celestial bodies can be determined by accessing the ephemeris or second category of information at a particular time and with reference to a specific geographical location. Further, the angle between the two pertinent planetary bodies (referred to in astrological terms as the geocentric angle) can be computed or determined by the processor 20 and the aforementioned designators, as presented in FIG. 5, are displayed on the screen or display surface 46' of the display assembly 40'. The user will thereby be informed whether a favorable or unfavorable influence is likely to exist at the particular time for a given subject matter. As indicated in FIG. 5 the various designator signs such as conjunctions, trines and sextiles may represent a "yes" answer and be indicative of a favorable influence on a given subject. To the contrary the designators referred to as oppositions and squares may represent a "no" answer and be indicative of an unfavorable influence on a given subject. In certain situations there will be no Aspect available, possibly because there isn't a significant angle worth noting, in terms of obtaining a "yes or no" designator sign, between the two pertinent celestial bodies or planets. The absence of an Aspect can be indicated on the display screen by depicting the designator sign 49' as shown in FIG. 5.

Again with reference to FIGS. 8 and 9, the embodiment of the celestial timepiece 10' may typically include the display of the Zodiac signs generally indicated as 70. As set forth above, the Zodiac signs comprise a portion of the first category of astrological information stored within the processor 20 and/or one or more of the databases 31 through 33. The first category of astrological information 70 may be displayed on the screen 46' by itself or concurrently with the display of other information. Such other information may include the time of day or other general information, as at 74, or an additional category of astrological information indicated as 72. This additional category 72 preferably includes an ascendant indication represented as "ASC" and/or a "mid-heaven" indication indicated as "MC". The position (indicated in degrees) and the Zodiac sign depicted, indicates that the Zodiac sign of Aries is passing through the ascendant (ASC), which is the line that indicates the beginning of the first House of the Zodiac, at the indicated time. In the example shown, at 3:51 pm and at a specified geographical location, it is shown that the $26^{th}$ degree of Aries occupies the ascendant (ASC). Concurrently the $26^{th}$ degree of Capricorn occupies the point that marks the mid-heaven (MC) location, which is representative of the sun being at its highest point in the sky.

With reference to FIGS. 3 through 6 each of the 12 Houses of the Zodiac is directly associated with the plurality of subjects as indicated. Also, each House is directly associated with a ruling celestial body or "planetary ruler" as presented in FIG. 4. Moreover, as set forth above, each of the planetary rulers is indicated by a planetary sign as appears in FIG. 6 and is directly associated with at least one of the Zodiac signs as indicated in FIG. 4.

Since all of the astrological information, as set forth above, is stored in the various categories of the astrological information within the central processor 20 and/or its associated databases 31, 32, 33, etc. operation of the embodiment 10' of the celestial timepiece is as follows;

1. If a user wishes to be informed of the existence of a favorable or unfavorable influence on a particular subject, then the House associated with the specific subject is determined, such as by referencing appropriate information of the type presented in FIG. 3. The user then determines which of the plurality of Zodiac signs 70 is representative of a House which is associated with the subject matter under inquiry.
2. Each of the Zodiac signs are depicted in an interrelated array which may be defined by a specific alignment or even more specifically by a stacked array such that opposite Houses of the 12 Houses of the Zodiac may be easily determined. By way of example, the Zodiac signs Aries indicated in FIG. 9 as 71 may be representative of one of the twelve Houses of the Zodiac associated with the particular subject of inquiry. The stacked array of interrelated Zodiac signs 70 is such that the House opposite to the House of Aries is the House of Libra, which is associated with Zodiac sign indicated as 73, located directly above the Zodiac sign for the House of Aries. To further aid the user in locating a specific Zodiac sign on the display screen 46', each of the Zodiac signs may be selectively highlighted, as by being illuminated and/or blinking. After reference to the information as set forth in FIG. 3, the user knows the House associated with the subject of inquiry, as well as the opposite House.
3. Now having this information, the planetary signs indicated in FIG. 6, being associated with at least one of the Zodiac signs indicated in FIG. 4, allows the user to easily determine that Mars is the planetary sign associated with the Zodiac sign Aries. Similarly, Venus is the planetary sign associated with Zodiac sign Libra. This information is appropriately "inputted" into the key pad assembly 80, wherein each of the planetary signs is represented by one of the indicator keys 82.
4. The user therefore, "inputs" the appropriate information into the key pad assembly 80 by the depressing the appropriate indicator keys and function keys as follows: Mars+Aspect+Venus=Sextile. In this example, the designator sign of the Sextile would appear on the display screen 46', indicating a "yes" or favorable influence on the subject of inquiry.

5. Displaying the Mars and Venus planetary signs is accomplished by pressing the appropriate indicator keys 82 having the planetary sign of Mars and Venus thereon. The function keys 84 are appropriately marked as Aspect, Sign, House, "=" for efficient use thereof. The result of the information input to the processor 20, as set forth in sub-paragraph 4 above, will be the display of one of the aforementioned designator signs 49 or 49' of FIG. 5. As set forth above, the appearance of the designators such as conjunctions, trines or sextiles, indicates a favorable influence on a given subject. To the contrary the appearance on the display surface 46' of the designator signs such as oppositions or squares, indicates an unfavorable influence of the given subject. The indication on the display surface 46' of the designator sign 49' indicates no Aspect being available for the particular subject.
6. The timely depression or activation of the clear button 86 is accomplished to initially and periodically clear the screen so that appropriate information can be inputted, by accessing the key pad assembly 80, and subsequently displayed, as set forth above.

Other more simplified functions may be performed using the celestial timepiece embodiment 10'. These functions include the accessing of a "daily food for thought message". The stacked array of Zodiac signs 70 appearing on the display face 46' includes the top 6 Zodiac signs 75, which represent individual planets, as indicated in FIG. 4. These "top row" of planets move faster in their orbital paths as they pass through the Zodiac. Therefore, the depression of the appropriate celestial body associated with anyone of the upper 6 Zodiac signs 75 and the depression of the Sign key 84, followed by the depression of the "=" key 84, will result in presentation of one of the designators 49 or 49', providing the user with indication of a positive or negative influence on the subject of "daily food for thought" inquiry.

Similarly, the sequential depression or otherwise manipulation of an appropriate planetary sign, being represented of one of the Zodiac signs, which is associated with one of the Houses relating to a particular subject matter, can first be depressed. The depression of the House key 84 followed by the depression of the "=" key 84, will produce the display of a designator sign 49 or 49'. Once again this provides the user with an indication of a positive or negative influence currently existing relative to a particular subject matter.

In addition to the above, the user, upon entering the date, time, specific geographical location, etc., may also enter his birth date, which is referred to in astrological terms as the users natal "sun sign". Inputting of the sun sign information into the central processor and/or additional databases associated therewith can be accomplished through manipulation of anyone or more of the control buttons 24', 26', 28', 30'. Accordingly, when the sun sign, representing the birth date of the user, passes through a particularly pertinent part of the Zodiac array, such as but not limited to, the ascendant (ASC) and/or the mid-heaven (MC) locations, an alarm 90 may be activated to immediately inform the user of such an occurrence. The passing of the natal sun sign degree of a person through the ascendant and/or mid-heaven locations of the Zodiac is considered to be lucky and/or influential on the user and accordingly the user may want to be notified of such occurrence. Furthermore, the alarm 90 could also be activated if or when any one of the celestial bodies or planets, while in their respective orbital paths, approaches or occupies the user's, or other person's, natal sun sign degree. The automatic activation of the alarm 90 may be in the form of an audible, visual, vibrational or any other applicable signal, which informs the user of the specific occurrence.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured to provide time related astrological information, said assembly comprising:

a) a casing including a display assembly mounted thereon in an exposed location, b) a processor mounted on said casing and structured to determine current time and store predetermined astrological information, c) said display assembly responsive to said processor and structured to display a plurality of different categories comprising at least a first category, a second category and a third category, d) a control assembly operatively connected to said processor and cooperatively structured therewith to activate said display assembly for selective display of at least some of said plurality of categories, e) said first category comprising a plurality of Zodiac signs observable on said display assembly in an interrelated array and a plurality of planetary signs each associated with at least one of said Zodiac signs and with one of a plurality of predetermined celestial bodies of the Zodiac, f) said second category comprising an ephemeris including stored data indicative of orbital paths of said predetermined celestial bodies and their relative positions at any time over a predetermined period of time, and g) said third category at least partially defined by a plurality of Aspects, each Aspect indicative of the relative positions and angular orientation of two celestial bodies each of which is representative of a different House of the Zodiac.

2. An assembly as recited in claim 1 wherein each of said Zodiac signs is representative of one of twelve Houses of the Zodiac.

3. An assembly as recited in claim 2 wherein said interrelated array comprises a cooperative positioning of Zodiac signs which are representative of opposite Houses of the Zodiac.

4. An assembly as recited in claim 3 wherein said interrelated array comprises an aligned orientation of Zodiac signs representative of opposite Houses of the Zodiac.

5. An assembly as recited in claim 4 wherein said cooperative positioning comprises a substantially stacked array of said plurality of Zodiac signs.

6. An assembly as recited in claim 5 wherein said stacked array comprises each of said Zodiac signs disposed above or below a Zodiac sign representative of an opposite House of the Zodiac.

7. An assembly as recited in claim 1 wherein said predetermined period of time is at least one year.

8. An assembly as recited in claim 1 wherein said control assembly comprises an operative display including each of said plurality of planetary signs.

9. An assembly as recited in claim 8 wherein said control assembly comprises a key pad assembly including a plurality of keys, each of said planetary signs represented by at least one of said keys.

10. An assembly as recited in claim 1 wherein at least a portion of said third category is selectively observable on said display assembly by predetermined manipulation of said control assembly to access information stored in said processor relating to a specific subject.

11. An assembly as recited in claim 10 wherein said control assembly comprises a key pad assembly including a plurality of keys, each of said planetary signs represented by at least one of said keys.

12. An assembly as recited in claim 11 wherein each of said planetary signs is associated with at least one of said Zodiac signs, each of said Zodiac signs being representative of a specific House of the Zodiac and each of said Houses of the Zodiac being associated with a plurality of pre-established subjects.

13. An assembly as recited in claim 11 wherein said third category comprises a plurality of designators each indicative of either a favorable or an unfavorable influence on a desired subject at a specific time of inquiry.

14. An assembly structured to provide timepiece related astrological information, said assembly comprising:

a) a casing including a display assembly mounted thereon in an exposed location, b) a processor mounted within said casing and structured to determine current time and store predetermined astrological information, c) said display assembly responsive to said processor and structured to display a plurality of different categories of said predetermined astrological information, d) a control assembly including a key pad assembly operatively connected to said processor and cooperatively structured therewith to selectively display at least two of said plurality of categories, e) an alarm assembly structured to indicate anyone of a plurality of astrological occurrences, and f) said plurality of astrological occurrences comprising anyone of the celestial bodies of the Zodiac, while in their orbital paths, approaching or occupying a person's natal sun sign and degree.

15. An assembly as recited in claim 14 wherein said plurality of categories include a first category comprising a plurality of Zodiac signs observable on said display assembly in an interrelated array.

16. An assembly as recited in claim 15 wherein said plurality of categories further include a second category comprising an ephemeris defined by data indicative of orbital paths of said predetermined celestial bodies and their relative positions at any time over a predetermined period of time.

17. An assembly as recited in claim 16 wherein said plurality of categories further comprise a third category defined by a plurality of Aspects, each Aspect indicative of the relative positions and angular orientation of two celestial bodies, each of which is representative of a different House of the Zodiac.

18. An assembly as recited in claim 17 wherein said interrelated array comprises a cooperative positioning of Zodiac signs representative of opposite Houses of the Zodiac, said cooperative positioning comprising an aligned orientation of the Zodiac signs representative of the opposite Houses of the Zodiac.

19. An assembly as recited in claim 18 wherein said cooperative positioning comprises a substantially stacked array of said plurality of Zodiac signs, each of said Zodiac signs disposed above or below a Zodiac sign representative of an opposite House of the Zodiac.

20. An assembly as recited in claim 17 wherein each of said planetary signs is represented by at least one of said keys of said key pad assembly.

21. An assembly as recited in claim 20 wherein at least a portion of said third category is selectively observable on said display assembly by predetermined manipulation of said plurality of keys of said key pad assembly to access information relating to a specific subject which is represented by a specific House of the Zodiac.

22. An assembly as recited in claim 14 wherein said processor comprises at least one database for storage of a location of a plurality of geographical locales.

23. An assembly as recited in claim 22 wherein said processor comprises at least one database for storage of time conversion data of Greenwich mean time to equivalent local time at each of said plurality of geographical locales.

24. An assembly as recited in claim 23 wherein said processor is further structured to cooperatively interact with said database to directly determine current relative positioning of said planetary bodies relative to a predetermined geographical locales and current time at the geographical locales.

25. An assembly as recited in claim 14 wherein said processor and said display assembly are cooperatively structured to compute and display a current time of day at a particular geographical location.

26. An assembly as recited in claim 14 wherein said processor and said display assembly are cooperatively structured to compute and display additional predetermined astrological information including ascendant information.

27. An assembly as recited in claim 14 wherein said processor and said display assembly are cooperatively structured to compute and display additional predetermined astrological information including mid-heaven information.

28. An assembly as recited in claim 14 wherein said plurality of astrological occurrences comprise the passage of a person's natal sun sign degree through either the ascendant or the mid-heaven locations of the zodiac.

* * * * *